US006075961A

United States Patent [19]

Seo

[11] Patent Number: 6,075,961

[45] Date of Patent: Jun. 13, 2000

[54] SQUEEZING APPARATUS OF LIQUID DEVELOPING APPARATUS

[75] Inventor: Ji-Won Seo, Gunpo, Rep. of Korea

[73] Assignee: Samsung Electronics Co., Ltd., Suwon, Japan

[21] Appl. No.: 09/359,443

[22] Filed: Jul. 22, 1999

[30] Foreign Application Priority Data

Jul. 22, 1998 [KR] Rep. of Korea ..... 98-29520

[51] Int. Cl.[7] ..... G03G 15/10

[52] U.S. Cl. ..... 399/249

[58] Field of Search ..... 399/222, 233, 399/234, 237, 249

[56] References Cited

U.S. PATENT DOCUMENTS

| | | | |
|---|---|---|---|
| Re. 34,437 | 11/1993 | Ariyama et al. | 399/237 |
| 3,741,643 | 6/1973 | Smith et al. | 399/249 |
| 4,259,006 | 3/1981 | Phillips et al. | 399/249 |
| 5,063,413 | 11/1991 | Domoto et al. | 399/249 |
| 5,157,443 | 10/1992 | Anderson et al. | 399/249 |
| 5,289,239 | 2/1994 | Day | 399/249 |

*Primary Examiner*—William Royer
*Assistant Examiner*—Rammon R. Fordé
*Attorney, Agent, or Firm*—Robert E. Bushell, Esq.

[57] ABSTRACT

A squeezing apparatus of a liquid developing apparatus including a mobile block installed under a photoreceptor web, the mobile block being capable of moving up and down, a squeeze roller supported by the mobile block and moving up and down with the mobile block, the squeeze roller contacts a transfer surface of the photoreceptor web when moving up and removes excess developer therefrom, an air injection nozzle, installed at the mobile block, for injecting air to a portion of the photoreceptor web where the squeeze roller contacts the photoreceptor web to separate and drip the excess developer downward, an air supply pump for supplying air to the air injection nozzle, and a bellows pipe connecting the air injection nozzle and the air supply pump and to be capable of expanding or being compressed as the mobile block moves up and down.

12 Claims, 3 Drawing Sheets

SQUEEZING APPARATUS OF LIQUID DEVELOPING APPARATUS

CLAIM OF PRIORITY

This application makes reference to, incorporates the same herein, and claims all benefits accruing under 35 U.S.C. § 119 arising from an application for a *Squeezing Apparatus of Liquid Developing Apparatus* earlier filed in the Korean Industrial Property Office on Jul. 22, 1998 and there duly assigned Ser. No. 29520/1998.

FIELD OF THE INVENTION

The present invention relates to a squeezing apparatus of a liquid developing apparatus including a squeeze roller for removing excess developer from a photoreceptor web and an air injection nozzle for injecting air to the squeeze roller.

DESCRIPTION OF THE RELATED ART

A liquid developing apparatus generally contains a mobile block which moves up and down from a transfer surface of a photoreceptor web. When developer is applied to the web, an air injection nozzle serves to remove excess toner from the surface of the web. Air supplied to the air injection nozzle may be interrupted if the pipe which supplies air to the moving air injection nozzle gets pinched.

SUMMARY OF THE INVENTION

To solve the above problem, it is an objective of the present invention to provide a squeezing apparatus of a liquid developing apparatus having a connection pipe which can uniformly maintain the sectional area of a path for air when the air injection nozzle moves up and down by the mobile block so that pressure in air injection can be uniformly maintained.

Accordingly, to achieve the above objective, there is provided a squeezing apparatus of a liquid developing apparatus which comprises a mobile block installed under a photoreceptor web to be capable of moving up and down, a squeeze roller supported by the mobile block and moving up and down, the squeeze roller contacts a transfer surface of the photoreceptor web when moving up and removes excess developer therefrom, an air injection nozzle installed at the mobile block, for injecting air to a portion where the photoreceptor web and the squeeze roller closely contact each other to separate and drip the excess developer downward, an air supply pump for supplying air to the air injection nozzle, and a bellows pipe connecting the air injection nozzle to the air supply pump, the bellows pipe is capable of expanding or being compressed as the mobile block moves up and down.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
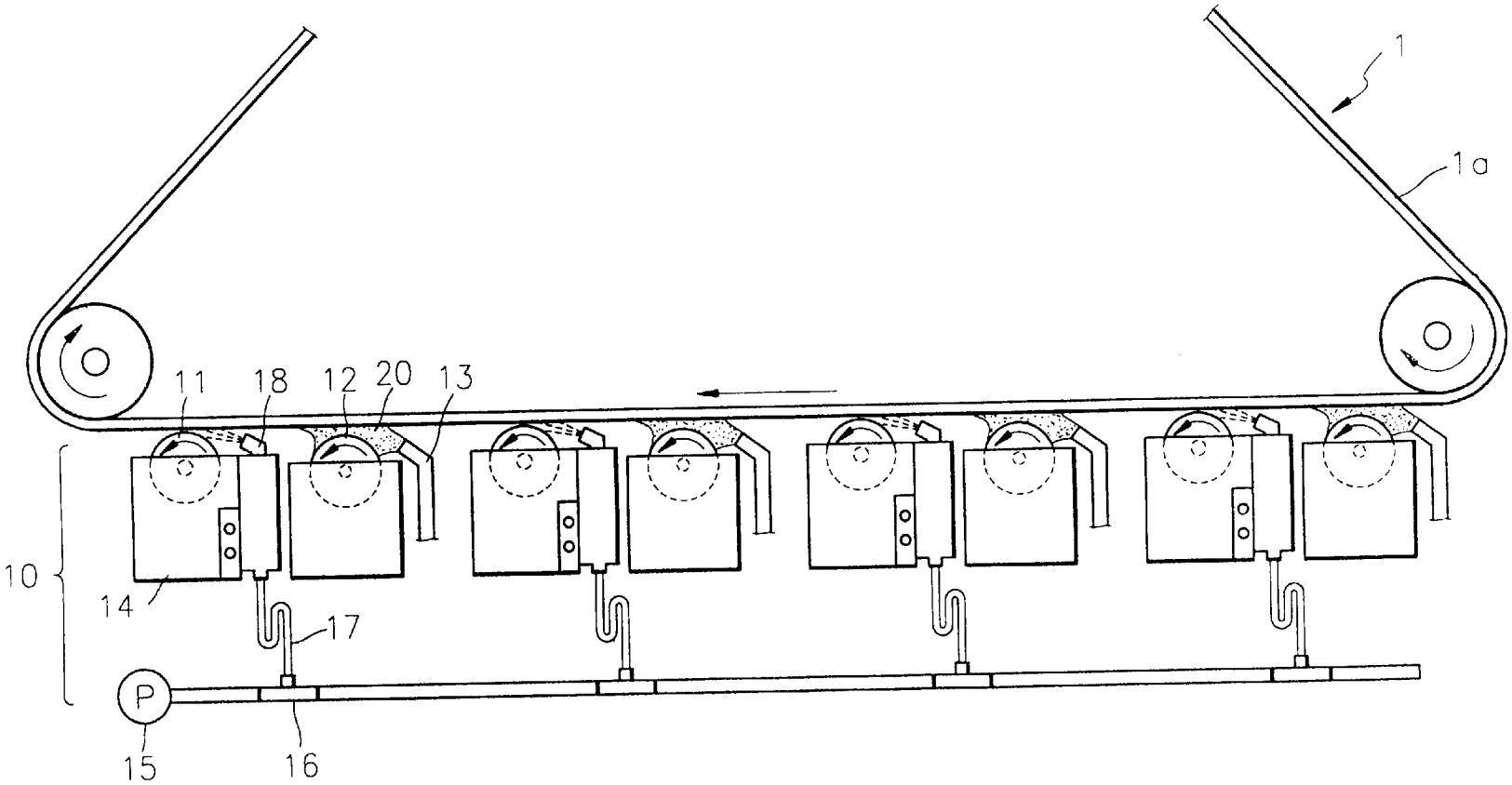
FIG. 1 (PRIOR ART)
FIG. 1 is a view showing a liquid developing apparatus adopting an earlier squeezing apparatus.

In a liquid electrophotographic printer, as shown in FIG. 1, there are a plurality of developing apparatuses 10 for developing an electrostatic latent image formed on a transfer surface 1*a* of a circulating photoreceptor web 1. The developing apparatus 10 each include developing roller 12 for supplying a developer 20 to the transfer surface 1*a* of the photoreceptor web 1 and a squeezing apparatus for collecting excess developer from the transfer surface 1*a* of the photoreceptor web 1.

The squeezing apparatus includes a squeeze roller 11 for squeezing the photoreceptor web 1 to remove excess developer and an air injection nozzle 18 for injecting air to the squeeze roller 11 to separate the developer adhering to the squeeze roller 11.

The squeeze roller 11 moves up and down by being supported by a mobile block 14 installed under the photoreceptor web 1 to be capable of moving up and down so that the squeeze roller 11 is selectively contacts the photoreceptor web 1. Here, the air injection nozzle 18 moves up and down together with the squeeze roller 11. The air injection nozzle 18 is fixed to the mobile block 14 such that an angle of air injection with respect to the squeeze roller 11 can be uniform. The air injection nozzle 18 is connected to an air supply pump 15 via a flexible connection pipe 17. Reference numeral 16 denotes a supply pipe through which the air supplied by the air supply pump 15 to each developing apparatus.

When the air supply pump 15 and the air injection nozzle 18 are connected by the connection pipe 17, the connection pipe 17 is bent as the mobile block 14 moves. At this time, if a portion of the connection pipe 17 is abnormally or excessively bent, the sectional area of a path through which air flows becomes narrow. Thus, air cannot be injected uniformly through the air injection nozzle 18, thus lowering the efficiency in removing developer.

Figure 2:
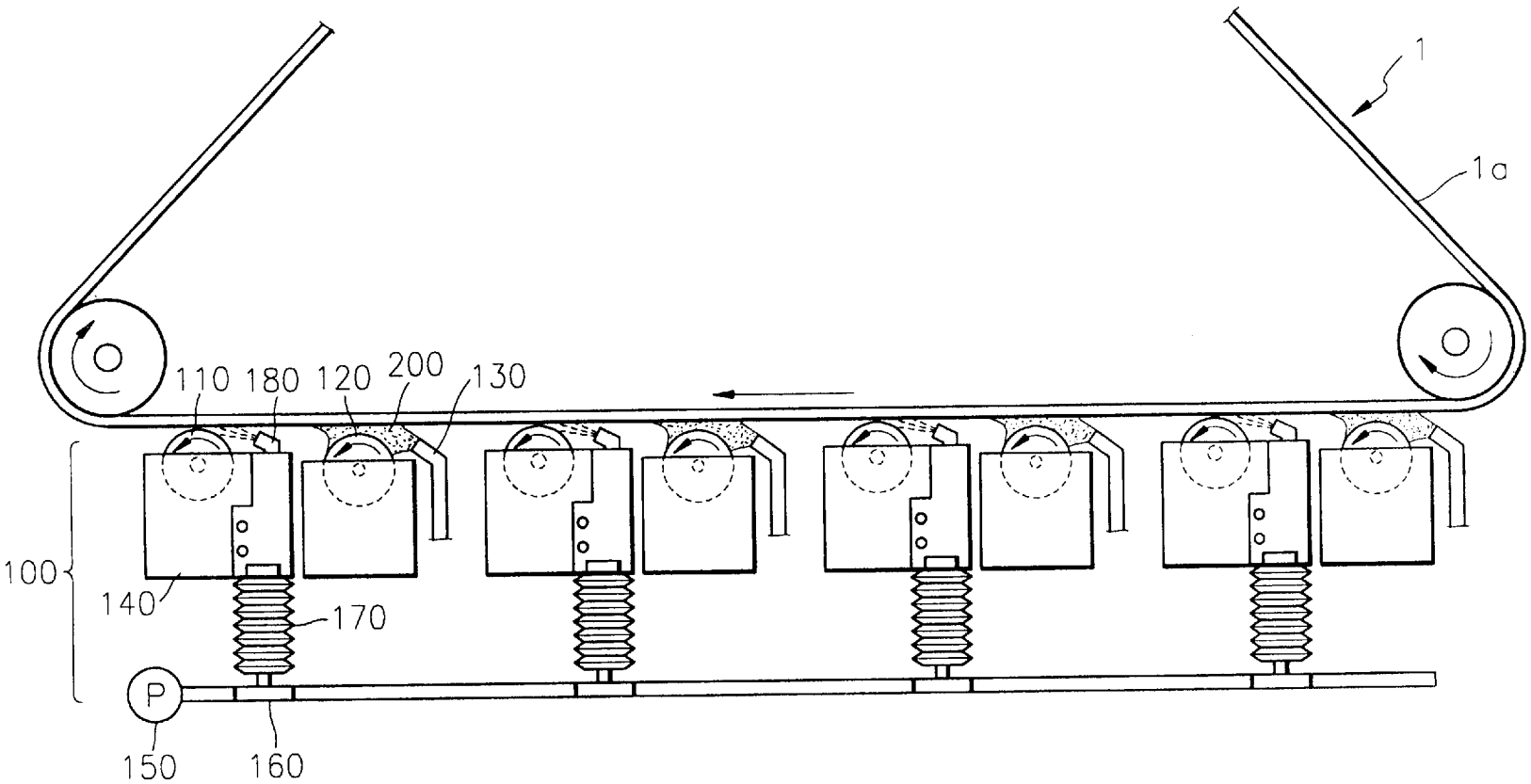
FIG. 2 is a view showing a liquid developing apparatus adopting a squeezing apparatus according to the present invention.

FIG. 2 shows a squeezing apparatus of a liquid developing apparatus according to the present invention. Referring to the drawing, a mobile block 140 is installed under the photoreceptor web 1 which is capable of moving up and down. A squeeze roller 110 and an air injection nozzle 180 are supported at the mobile block 140. The squeeze roller 110 moves up and down together with the mobile block 140 and selectively contacts the transfer surface 1*a* of the photoreceptor web 1 to remove excess developer.

The air injection nozzle 180 injects air towards where the photoreceptor web 1 and the squeeze roller 110 closely contact each other to separate and drip the excess developer downward. The air injection nozzle 180 is fixed to the mobile block 140 such that the angle of air injection with respect to the squeeze roller 110 can be uniform. The air supply pump 150 supplies air to the air injection nozzle 180. The air supplied from the air supply pump 150 is supplied to each developing apparatus 100 through a supply pipe 160.

According to the present invention, the air injection nozzle 180 and the supply pipe 160 are connected by a bellows pipe 170. Bellows pipe 170 is capable of being compressed or expanded. That is, when the air injection nozzle 180 moves up and down with the mobile block 140, the bellows pipe 170 expands or is compressed. Reference numeral 120 denotes a developing roller for developing an electrostatic latent image by supplying developer 200 to the transfer surface 1*a* of the photoreceptor web 1 and reference numeral 130 denotes a developer supply apparatus.

Figure 3:
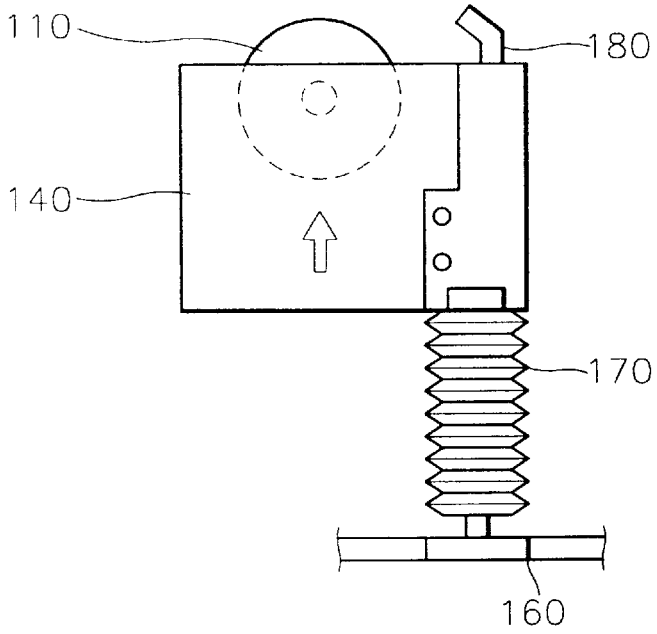
FIGS. 3 and 4 are views for explaining the operation of the squeezing apparatus according to the present invention.
Figure 4:
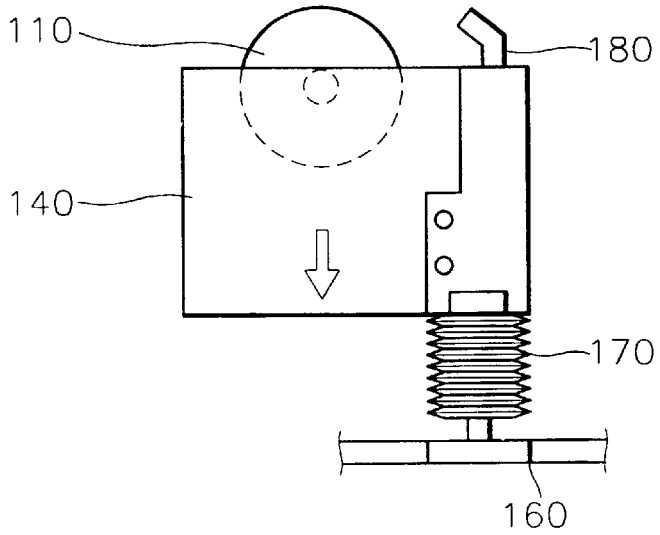

In the operation of the squeeze roller having the above structure according to the present invention, when the mobile block 140 moves up, the air injection nozzle 180 supported by the mobile block 140 also moves up. Thus, as shown in FIG. 3, the bellows pipe 170 expands. When the mobile block 140 moves down, the air injection nozzle 180 also moves down. Thus, as shown in FIG. 4, the bellows pipe 170 is compressed.

As described above, according to the squeezing apparatus of the present invention, the air injection nozzle 180 and the supply pipe 160 are connected by the bellows pipe 170 and, when the mobile block 140 and the air injection nozzle 180 move up and down, the bellows pipe 170 extends or is compressed so that the sectional area of the path for air can be uniformly maintained. Thus, pressure of air injected through the air injection nozzle 180 can be uniformly maintained so that excess developer can be removed efficiently.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A squeezing apparatus of a liquid developing apparatus comprising:

a mobile block installed under a photoreceptor web capable of moving up and down;

a squeeze roller supported by said mobile block and moving up and down with said mobile block, said squeeze roller contacts a transfer surface of said photoreceptor web when moving up and removes excess developer therefrom;

an air injection nozzle, installed at said mobile block, for injecting air to a portion of said photoreceptor web where said squeeze roller contacts said photoreceptor web to separate and drip the excess developer downward;

an air supply pump for supplying air to said air injection nozzle; and a bellows pipe connecting said air injection nozzle to said air supply pump, said bellows pipe capable of expanding or being compressed as said mobile block moves up and down.

2. The squeezing apparatus of claim 1, wherein said air injection nozzle is fixed to said mobile block such that the angle of air injection with respect to the squeeze roller can be uniform.

3. The squeezing apparatus of claim 1, further comprising a supply pipe disposed between said air supply pump and said bellows pipe that supplies air to said bellows pipe from said air supply pump.

4. The squeezing apparatus of claim 3, wherein said air injection nozzle is fixed to said mobile block such that the angle of air injection with respect to the squeeze roller can be uniform.

5. The squeezing apparatus of claim 4, wherein when said bellows pipe is expanding and being compressed, the sectional area of the path for air in said bellows pipe can be uniformily maintained.

6. The squeezing apparatus of claim 1, wherein when said bellows pipe is expanding and being compressed, the sectional area of the path for air in said bellows pipe can be uniformity maintained.

7. A method of removing excess developer efficiently from a transfer surface, comprising the steps of:

installing, under a photoreceptor web capable of moving up and down, a mobile block;

supporting a squeeze roller by said mobile block causing said squeeze roller to move up and down with said mobile block;

contacting said transfer surface of said photoreceptor web when said squeeze roller is moved up to remove excess developer;

installing an air injection nozzle on said mobile block;

injecting air to a portion of said photoreceptor web where said squeeze roller contacts said photoreceptor web separating and dripping excess developer downward;

providing an air supply pump to supply air to said air injection nozzle;

connecting a bellows pipe to said air injection nozzle and said air supply pump; and expanding and compressing said bellows pipe as said mobile block moves up and down.

8. The method of claim 7, wherein said air injection nozzle is fixed to said mobile block such that the angle of air injection with respect to the squeeze roller can be uniform.

9. The method of claim 7, further comprising the step of placing a supply pipe between said air supply pump and said bellows pipe to supply air to said bellows pipe from said air supply pump.

10. The method of claim 9, wherein said air injection nozzle is fixed to said mobile block such that the angle of air injection with respect to the squeeze roller can be uniform.

11. The method of claim 10, wherein when said bellows pipe is expanding and being compressed, the sectional area of the path for air in said bellows pipe can be uniformly maintained.

12. The method of claim 7, wherein when said bellows pipe is expanding and being compressed, the sectional area of the path for air in said bellows pipe can be uniformly maintained.

* * * * *